US012642318B2

(12) United States Patent
Tannebaum

(10) Patent No.: US 12,642,318 B2
(45) Date of Patent: Jun. 2, 2026

(54) KNITTED FABRIC ARTICLE

(71) Applicant: MEDI GMBH & CO. KG, Bayreuth (DE)

(72) Inventor: Wolfgang Tannebaum, Weiden (DE)

(73) Assignee: medi GmbH & Co. KG, Bayreuth (DE)

( * ) Notice: Subject to any disclaimer, the term of this patent is extended or adjusted under 35 U.S.C. 154(b) by 153 days.

(21) Appl. No.: 18/252,867

(22) PCT Filed: Oct. 14, 2021

(86) PCT No.: PCT/EP2021/078429
§ 371 (c)(1),
(2) Date: May 12, 2023

(87) PCT Pub. No.: WO2022/117252
PCT Pub. Date: Jun. 9, 2022

(65) Prior Publication Data

US 2023/0413931 A1 Dec. 28, 2023

(30) Foreign Application Priority Data

Dec. 4, 2020 (DE) ..... 20211940.0

(51) Int. Cl.

| | |
|---|---|
| ***D04B 1/26*** | (2006.01) |
| ***A41D 27/00*** | (2006.01) |
| ***D04B 1/18*** | (2006.01) |
| ***D04B 1/24*** | (2006.01) |

(52) U.S. Cl.
CPC ..... *A41D 27/00* (2013.01); *D04B 1/18* (2013.01); *D04B 1/246* (2013.01); *D04B 1/26* (2013.01); *A41D 2400/44* (2013.01)

(58) Field of Classification Search
CPC ..... A41D 13/08; A41D 13/06; A41B 11/00; D04B 1/26
See application file for complete search history.

(56) References Cited

U.S. PATENT DOCUMENTS

| | | | | |
|---|---|---|---|---|
| 4,005,494 A * | 2/1977 | Burn | D04B 1/26 | 2/239 |
| 4,373,215 A * | 2/1983 | Guigley | D04B 1/26 | 2/239 |
| 4,856,112 A * | 8/1989 | Effle | A41D 13/08 | D2/612 |
| 6,192,519 B1 * | 2/2001 | Coalter | A41D 13/088 | 2/16 |
| 6,401,247 B1 * | 6/2002 | Williams, IV | A41D 13/08 | 602/62 |
| 6,665,876 B1 * | 12/2003 | Newman | A41D 13/08 | 2/207 |

(Continued)

FOREIGN PATENT DOCUMENTS

| | | | |
|---|---|---|---|
| DE | 69912104 | 4/2004 | |
| EP | 4008819 A1 * | 6/2022 | A41D 27/00 |

(Continued)

*Primary Examiner* — Tajash D Patel
(74) *Attorney, Agent, or Firm* — Rimon PC

(57) ABSTRACT

Knitted fabric article having a leg or arm section to be pulled over at least a section of a leg or arm, wherein at least one manually grippable pulling element is provided on the inside of the leg or arm section.

18 Claims, 5 Drawing Sheets

(56) References Cited

U.S. PATENT DOCUMENTS

Figure 1:
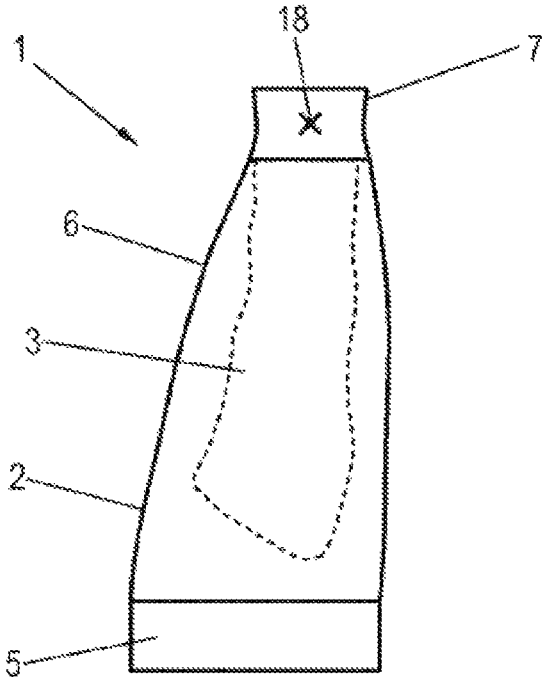

| | | | | |
|---|---|---|---|---|
| 6,826,779 | B1 * | 12/2004 | McKenzie | A41D 13/08 2/16 |
| 7,076,973 | B1 * | 7/2006 | Chesebro, Jr. | D04B 9/54 66/178 R |
| 7,975,886 | B2 * | 7/2011 | McAllister | A47G 25/905 223/111 |
| 8,479,313 | B2 * | 7/2013 | Jones | A41D 13/015 2/16 |
| 2017/0156425 | A1 * | 6/2017 | Jeong | A41D 27/02 |
| 2020/0205481 | A1 * | 7/2020 | Amis | D04B 1/18 |
| 2024/0260680 | A1 * | 8/2024 | Hunt | A41B 11/00 |

FOREIGN PATENT DOCUMENTS

| | | | | |
|---|---|---|---|---|
| FR | 2813323 | | 3/2002 | |
| WO | 2009092932 | | 7/2009 | |
| WO | WO-2021045986 | A1 * | 3/2021 | A41B 11/00 |

* cited by examiner

KNITTED FABRIC ARTICLE

CROSS-REFERENCE TO RELATED APPLICATIONS

This application claims priority to international application no. PCT/EP2021/078429, filed on Oct. 14, 2021, which claims the benefit of priority to European Patent application no. 20211940.0, filed on Dec. 4, 2020, the contents of which are incorporated herein by reference in its entirety as if set forth herein.

The invention relates to a knitted fabric article comprising a leg or arm section to be pulled over at least one section of a leg or arm.

Such knitted fabric articles are known in different variants. A knitted fabric article can be designed as a simple calf stocking, for example, or as a longer stocking that extends to the knee, or as a thigh-length stocking that also extends over the thigh. The design as tights is also known. The knitted fabric article can comprise only a leg section that only extends to or also over the ankle, but no longer encloses the heel and the foot. Alternatively, the knitted fabric article can additionally include a foot section which is attached to the leg section and which, as is known in the case of stockings or tights, surrounds the entire foot. In addition, such a knitted fabric article can also be designed as an armsleeve which, for example, is only pulled over the forearm, or also extends over the upper arm. The armsleeve can, for example, only extend as far as the wrist with an arm section. Alternatively, the arm section can be adjoined by a hand section that encloses at least part of the palm of the hand or the entire hand with the fingers.

The knitted fabric article can be a normal item of clothing, i.e., a commercially available stocking or commercially available tights or the like, which has no assigned or inherent function. However, equipping such a knitted fabric article with a specific function is also known, for example in the form of a compressive knitted fabric article, using which pressure is exerted on the underlying enclosed tissue, for example for therapeutic purposes, if the knitted fabric article is to be used to care for a person, or if the item of clothing is worn during sports where a certain pressure can have an advantageous effect.

As is well known, in order to put on a stocking or tights and pull it over the leg, it is necessary to change one's posture significantly, and on the one hand to bend forward with the upper body, but on the other hand also to bend the leg accordingly. This is often difficult, especially for older people or people with restricted mobility. In particular, it is often difficult to pull the knitted fabric article over the heel, for example, since the knitted fabric article is sometimes difficult to grip or the required traction cannot be applied. It is then often necessary when dressing to obtain assistance from a second person, who puts on the stocking. It is also sometimes difficult for this person to get the stocking or tights into the wearing position. The situation is similar with an armsleeve, although in this case the body position does not have to be changed as severely as when putting on a piece of leg clothing.

The problems are exacerbated when the knitted fabric article is provided with a compressive function, i.e., when it is a compressive knitted fabric article. In this case, typically at least one elastic thread, usually as a weft thread, is introduced into the basic knit of the knitted fabric article, which is knitted from at least one knitted thread, which gives the knitted fabric article the compressive property. This results in a problem that sometimes cannot be overcome by a single person when dressing, namely when the compressive knitted fabric article is to be pulled over the heel in particular, resulting from the geometry of the foot in the heel area. Even an assistant often has significant problems with this.

The invention is therefore based on the problem of specifying a knitted fabric article improved in relation thereto.

In order to solve this problem, is provided according to the invention in a knitted fabric article of the type mentioned at the outset that at least one manually grippable pulling element is provided on the inside of the leg or arm section.

The knitted fabric article according to the invention is provided with at least one pulling element provided on the inside of the leg or arm section, which can be gripped by a person when putting on the knitted fabric article and which can be pulled appropriately strongly when dressing, for example in the longitudinal direction of the leg. This grip part now enables the person, be it the person wearing the leggings himself or an assistant or caregiver, to be able to put on the knitted fabric article much more easily. This is because by gripping the pulling element, a greater pull can be applied along the leg or arm, so that the knitted fabric article can be pulled better along the leg or arm.

The pulling element is located on the inside of the leg or arm section, and preferably at a longitudinal position spaced apart from the upper edge of the leg or arm section that is pulled furthest along the leg or arm and the lower edge of the leg or arm section, which extends either to the ankle or beyond the ankle to the heel or to the wrist. This is because the tubular knitted fabric article, which can be knitted as a circular knitted fabric or as a flat knitted fabric, is usually designed varying in diameter, wherein the diameter usually expands significantly from the lower edge in the area of the ankle or heel or wrist, respectively, toward the upper edge. This means that the leg or arm section area having larger diameter can be pulled without problems over the narrower leg or arm section, but also over the heel, while problems can occur when pulling over the narrower leg or arm section area, resulting from the small diameter in comparison to the given anatomical conditions and the resulting friction of the knitted fabric article on the body part. If the at least one pulling element is located in an area closer to the lower end of the leg or arm section than to the upper end, the longitudinal pull can be applied directly in the leg or arm section area that is problematic when putting it on by pulling on the pulling element, i.e., ultimately the leg or arm section area that is difficult to pull on is pulled directly and consequently the traction is greater than if only the upper end of the leg or arm section were pulled, resulting in a corresponding stretching of the entire leg or arm section.

By arranging the at least one manually grippable pulling element on the inside of the leg or arm section of the knitted fabric article, no matter how this is now specifically carried out, putting on the knitted fabric article can as a result be significantly simplified, both in the case that the person himself wants to put on the knitted fabric article, as well as in the case that the knitted fabric article is put on a person by a second person. As stated, the knitted fabric article can either be a commercially available knitted fabric article, for example a simple stocking or simple tights or the like, i.e., a knitted fabric article without a specific, in particular compressive function. Similarly, however, it can also be a compressive knitted fabric article, for example a compression leg sleeve or armsleeve, wherein such a compressive knitted fabric article is designed in particular in accordance with the regulations of the German industrial norm DIN 58133 (medical compression stockings).

The knitted fabric article according to the invention can also be one having a foot section that adjoins the leg section, wherein in such a case the foot section runs to just above the heel and ends below the ankle, which is then adjoined by the leg section. However, it can also be a knitted fabric article only comprising a leg section which, depending on the design, ends above the ankle or below the ankle in the area of the heel. Correspondingly, an armsleeve can also only consist of an arm section that extends to the wrist or slightly beyond the wrist, but does not enclose the palm of the hand and the fingers. Alternatively, the armsleeve can also be provided with a hand section, which then only encloses the palm of the hand, or also the fingers in addition.

It is conceivable that only one pulling element is provided, which designed to extend annularly around the inner circumference of the leg or arm section. This annular pulling element is connected to the leg or arm section at one end and is otherwise exposed so that it can be gripped without problems. It is designed as a closed ring, which is advantageous in that a longitudinal pull can be applied over a large part of the circumference up to the entire circumference when the pulling element is pulled on the adjoining leg or arm section region.

As an alternative to the annular design of a pulling element, only one local pulling element, or preferably two local pulling elements arranged opposite to one another on the inner circumference, can also be provided. The local pulling element or elements are also arranged and fixed with one end on the inner circumference of the leg or arm section, while the pulling element is otherwise exposed and can therefore be gripped without problems. Using such a local, quasi-tab-like pulling element, only a local pull can be exerted, which, however, is often already sufficient to simplify putting on the article, in particular when two pulling elements positioned opposite to one another on the inner circumference are provided.

Different variants are conceivable with regard to the design of a pulling element. According to a first variant, the pulling element or elements can be knitted elements. This means that, just like the knitted fabric article having its knitted basic knitted fabric itself, the pulling element or elements are also knitted fabrics, consisting of a basic knitted fabric knitted using at least one knitted thread. Since the pulling elements are only a few centimeters long, there is no appreciable stretching of the pulling element knitted fabric when the pulling element or elements are pulled, so that the pull is introduced quasi-directly into the actual leg or arm knitted fabric.

Alternatively to the design of the pulling elements as knitted pulling elements, it is also conceivable that the pulling element or elements are made of a flexible, flat material, in particular a plastic material. In this case, a knitted fabric is not used, but rather a flat material, in particular in the form of a plastic film or the like, which flat material is fastened in a suitable manner on the inner circumference of the leg or arm section. This flat material is slightly to hardly elastic, in particular in the longitudinal direction of the leg or arm section, so that when this material is pulled, there is no appreciable stretching, but here again the pull is introduced almost directly into the leg section or arm section knitted fabric.

If one or more knitted pulling elements are provided, a particularly advantageous refinement of the invention provides that the knitted pulling element or elements are knitted in one piece with the leg or arm section. This means that the pulling element or elements are also knitted directly when the leg or arm section is knitted. A knitted fabric article according to the invention is either knitted on a circular knitting machine as a circular knitted fabric using at least one knitted thread, or on a flat knitting machine as a flat knitted fabric also using at least one knitted thread. By appropriate control, the pulling element or elements can readily be knitted directly onto the leg or arm section to be knitted. It is conceivable, for example, to knit the leg or arm section a little, beginning at the top or bottom end and then to quasi-reverse the knitting direction to form the pulling element or elements and knit back a little again, depending on the desired length of the pull section or sections, so that a second knitted layer is quasi-formed in the pulling element, which is then knitted back with the basic knitted fabric at a reversal point, after which the rest of the leg or arm section is knitted up to its other end. This is only one example of a possibility of forming the pulling element or elements in one piece by knitting when producing the leg or arm section or the knitted fabric article.

Alternatively, it is also conceivable to use one or more separate knitted pulling elements, which are therefore knitted separately. These merely need to be firmly fastened on the inner circumference of the leg or arm section, either by sewing or adhesive bonding to the inside of the leg or arm section. In this way, i.e., by sewing or adhesive bonding, the non-knitted pulling element or elements made of a flexible flat material can also be fastened on the leg or arm section.

It is advantageous if the knitted pulling element or elements, whether they are connected in one piece to the leg or arm section or whether they are sewn on or adhesively bonded separately, are knitted from a thinner thread than the actual basic knitted fabric. As a result, the thickness of the pulling element knitted fabric can be less than the thickness of the actual base knitted fabric of the leg or arm section. After, as described, the pulling element or elements are arranged quasi-freely movable on the inner circumference, correspondingly thinly knitted pulling elements hardly protrude when the knitted fabric article is in the wearing position. It is conceivable to work with a thinner knitting thread both with a one-piece design of the pulling element or elements on the leg or arm section; only a thread change is required for knitting the pulling element or elements in the otherwise continuous knitting process. Separately knitted pulling elements can be knitted from a thin knitting thread in any case. But even when using a flat material, it is expedient if this is thinner than the basic knitted fabric of the leg or arm section, so that this also protrudes hardly or not at all. This is readily possible when using a film material in particular.

As described, the knitted fabric article according to the invention can be designed solely as a piece of clothing, without a specific functional finish. According to the invention, however, at least the leg or arm section can be designed to be compressive, at least in sections. This means that the knitted fabric article has compressive properties, at least in sections, in particular in accordance with the specifications and parameters defined in DIN 58133. This means that the leg or arm section has a compressive property either over a part of its length or over its entire length, thus exerting a relatively high supporting pressure on the underlying tissue. If the knitted fabric article is additionally provided with a foot section or a hand section, the compressive property can also be present in this area, but this is not mandatory. The compression of the knitted fabric article can be determined using an appropriate measuring device, as for example in DIN 58133 or the comparable quality assurance RAL-GZ 387/1 "Medizinische Kompressionsstrümpfe [Medical compression stockings]" of the German Institute for Quality Assurance and Labeling e.V. The "HOSY" or "HOSYcan" testing device, which is used in particular for the compression pressure measurement on compression textiles, in particular medical compression textiles, from the Hohenstein Textile Testing Institute GmbH & Co. KG is preferably used for this purpose.

The compressive property is produced in a manner known per se by introducing an elastic thread into the basic knitted fabric of the knitted fabric article. The elastic thread is usually introduced as a weft thread. As already described, significant problems arise when the knitted fabric article is designed as a compression knitted fabric when getting dressed due to the compressive properties. This is because the knitted fabric article is stretched circumferentially in the wearing position, wherein this stretching is opposed with a resistance by the elastic thread, via which the pressure is generated. This means that in the unloaded state, the diameter of the knitted fabric article, in particular in the leg or arm section area that is pulled over thinner leg or arm areas, is remarkably small, so that there is high friction very early on when putting it on, which has to be overcome by the longitudinal pull. A significant problem also arises in the case of a leg knitted fabric article when the knitted fabric article is to be pulled with the section having a smaller diameter over the heel, since the foot area having the heel is relatively wide compared to the unstretched diameter of the knitted fabric article section. The significant advantages of the arrangement of the pulling element or elements according to the invention are evident in particular in the case of a compressive knitted fabric article. This is because with the aid of the pulling element or elements, a large pull can be exerted on the knitted fabric article in the longitudinal direction, which makes it easier to pull over, for example, the heel or along the leg or arm.

If the pulling element is designed extending annularly around the circumference, there is the possibility of not making the pulling element compressive, i.e., solely knitting it from a knitting thread or embodying it from a flat material that is not elastic in the circumferential direction. However, it is also conceivable to design this annular circumferential pulling element to be compressive, which means that this pulling element itself also has compressive properties, not just the leg or arm section. This compressive property in the circumferential direction can in turn be imparted to a knitted annular pulling element by introducing an elastic thread or compression thread, for example by introducing it as a weft thread or by loop-forming knitting with the base knitting thread. In the case of a flat material, a corresponding material elastic at least in the circumferential direction or plastic material can be used, which opposes the circumferential stretching with a corresponding resistance.

If a compressive annular pulling element is provided, both the annular pulling element and the leg or arm section can be compressive in the overlapping area with the pulling element. This means that both the leg or arm section and the pulling element have compressive properties. Both overlap in an overlapping area, which means that local compression is provided there both on the part of the pulling element and on the leg or arm section. Both compressions are therefore superimposed to form an overall compression in the overlapping area. In the overlapping area there is then locally a higher compression than in the adjoining areas in which the compression is only generated by the leg or arm section. This means that there is advantageously a compression increased locally due to superposition of the base compression on the part of the leg or arm section with the compression of the pulling element.

The compressive pulling element and the leg section compressive in the overlapping area can be at least approximately equally strongly compressive. That is, they have almost or completely the same compressive properties. "Approximately equally strongly compressive" also means a compression difference of up to at most +/−10%. Alternatively, it is conceivable that the compressive properties of the pulling element and the leg or arm section differ, i.e., deviate significantly from one another here. The overall compression in the overlapping area can be varied over a wide spectrum via this. This applies both to a pulling element knitted on in one piece and to a separately knitted pulling element, since a less or more compressive elastic thread can be used in each case in comparison to the elastic thread of the basic knitted fabric of the leg or arm section. In the same way, a variation of the overall compression in the overlapping area can of course also be achieved when using a flat material that is elastic at least in the circumferential direction by selecting its elasticity.

It is particularly preferred if the compressive annular pulling element is arranged in the area B or B1 according to DIN 58133. DIN 58133 defines specific positions along the leg section for compression stockings (this includes both individual stockings and tights), via which a desired pressure profile along the leg section can be defined. A higher compression pressure is usually required at the positions B or B1 than in adjacent areas, wherein the position B is very close to the ankle joint, namely is at the ankle, while position B1 is somewhat further away from it towards the knee. In the area B, the highest compression pressure is usually required for medical or therapeutic purposes. By superimposing the individual compression pressures of the leg section and the annular pulling element, these can advantageously be designed to be correspondingly high, and consequently the corresponding gradient can be formed along the leg section.

A significant advantage of the arrangement of the pulling element in this B or B1 area can also be seen in the fact that in the wearing position, due to the individual pressure superimposition, a overall pressure results that is greater than the base pressure that would only be generated via the compressive leg or arm section in this overlapping area. However, since the overlap is only given in the wearing position, but not when putting on the article, since the pulling element is still free and is gripped and pulled, but the leg section has not yet been pulled via this into the wearing position, the dressing process is simplified with regard to the significantly increased overall pressure resulting in the wearing position. This is because if such a high overall pressure were generated locally solely via the leg section, it would be significantly less stretchable and would be even more difficult to put on. Ultimately, a compression pressure can be set by this individual pressure superposition with respect to the overlapping area that is at least one compression class (according to DIN 58133, which defines specific compression classes) higher than the compression class that corresponds to the base pressure given only via the compressive leg section.

Particularly in the case of a long knitted fabric article or a long leg or arm section, it is expedient if at least one further pulling element is provided along the leg or arm section at at least one longitudinal position on the inside. This means that the leg or arm section, seen over its length, is equipped with one or more pulling elements in each case at at least two longitudinal positions or longitudinal planes. This can be any pulling element as described above, i.e., an element which is knitted and, for example, knitted in one piece or multiple such elements, or a pulling element manufactured from a flat material, etc. The arrangement of multiple such pulling elements at different longitudinal positions advantageously enables quasi-step-by-step pulling up, since it is possible to pull at two different longitudinal positions in a defined manner, for example. If the knitted fabric article is, for example, a leg stocking that extends to the thigh, the leg stocking can first be pulled into a wearing position in relation to the lower area, which encloses part of the lower leg, at the first pulling element closer to the lower end, after which the leg stocking is pulled into the wearing position over the knee via the pulling element or elements at the second longitudinal position, whereupon the last leg section area is then pulled into the wearing position on the thigh by gripping at the upper edge. A successive, step-by-step longitudinal pulling of only specific leg section areas via the individual pulling elements at the different longitudinal positions is therefore possible. Since a direct longitudinal pull can be introduced locally into the knitted fabric in the best possible manner via this, getting dressed can be significantly simplified.

As described, in the wearing position the pulling element or elements lie below the leg or arm section, so that there is a quasi-doubling of the layers in this area. In order to avoid this being excessively noticeable in the wearing position, it is conceivable to knit in padding that increases the thickness of the knitted fabric, at least in sections, on the inside of the leg or arm section. This means that the inside is additionally equipped with a plush layer, for example, which means that the basic knitted fabric is knitted as a plush layer on the inside. This padding or plush extends close to the edge of the pulling element, so that the layer doubling by the pulling element can be at least partially compensated for via this padding. This padding or plush layer can, quasi-adjoining the pulling element, only extend over a shorter longitudinal section of the leg or arm section, or over its entire remaining length. Of course, such padding can be provided on both sides of the pulling element, for example the annular pulling element. In the wearing position, no edge or only a barely visible edge then forms at the transition from the double area to the single area formed only by the padded leg or arm section.

One expedient refinement of the invention provides that at least one optical marking, which indicates the location of the heel or hand section that is turned inside out in the basic position, is provided on the inside of the leg or arm section or on the pulling element In the basic position, in which the knitted fabric article is provided before it is put on, the knitted fabric article is turned inside out, i.e., the leg or arm section is turned inside out in sections starting from the form which is not turned inside out, and in which the knitted fabric outside is on the outside and the knitted fabric inside is on the inside, so that ultimately two superimposed layers result. If the knitted fabric article is provided with a foot section or a hand section, the foot section or hand section is located inside this arrangement turned inside out. The foot section and the hand section have a specific geometry. The heel is formed on the foot section, and when the toe is closed, a tip geometry corresponding to the shape of the toe is formed there. The palm of the hand is formed on the hand section, having a defined upper and lower side, and possibly the fingers. It is of course necessary to position the knitted fabric article turned inside out having the correct foot section and hand section orientation when slipping it on with the foot or hand so that the foot plunges correctly into the foot section or the hand into the hand section, respectively. Since the foot section and hand section are turned inside out in this basic position, i.e., are not visible, the invention provides for the attachment of an optical marking on the inside of the leg or arm section or on the pulling element, respectively, via which the user can immediately recognize the position into which he has to bring the leg stocking or armsleeve, etc., so that he can slip it on in the correct position. Such an optical marking can, for example, be a knitted-in thread or a colored imprint or the like. Any form of optical marking that enables easy detection is suitable.

Furthermore, it is conceivable that the pulling element has a different color than the leg or arm section. This makes it possible to easily identify the pulling element itself or its position, particularly in rather poor light or with reduced visual acuity, since the pulling element is clearly different in color from the basic knitted fabric.

As already described, the knitted fabric article itself can be designed in different forms. It can be a calf stocking, a half-thigh stocking, a thigh-length stocking, or tights, wherein a foot section adjoining the leg section can possibly be provided, but does not necessarily have to be provided. If such a foot section is provided, it can be closed in the toe area, i.e., envelop the toes, or it can be open. Alternatively, the knitted fabric article can also be a half armsleeve or an armsleeve, which can optionally have a hand section adjoining the arm section, but does not have to. This hand section can also be closed, i.e., envelop both the palm of the hand and the fingers, or open, i.e., the fingers are not enclosed.

In addition to the knitted fabric article itself, the invention furthermore relates to a method of putting on a knitted fabric article of the above-described type. This method is distinguished in that the knitted fabric article located in the basic position, in which the leg or arm section, having its inside facing outward, is turned inside out and possibly slipped over the foot or hand section, if provided, is pulled over the foot or the hand by pulling on the at least one pulling element, after which the leg or arm section is pulled further over the leg or the arm into the wearing position either by gripping and pulling on an edge section of the leg or arm section, or is pulled further over the leg or arm by gripping and pulling on at least one further pulling element and then is pulled into the wearing position by gripping and pulling on an edge section of the leg or arm section.

Figure 2:
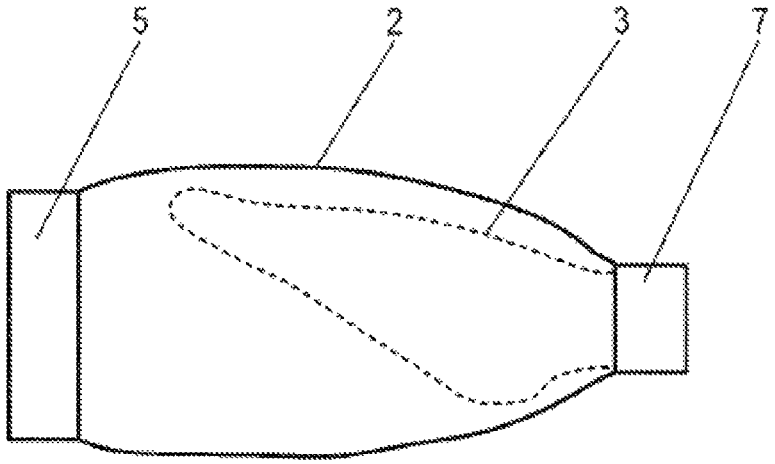
Figure 3:
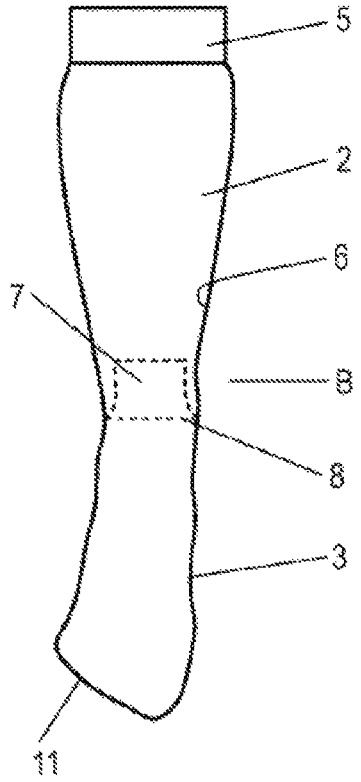
Figure 4:
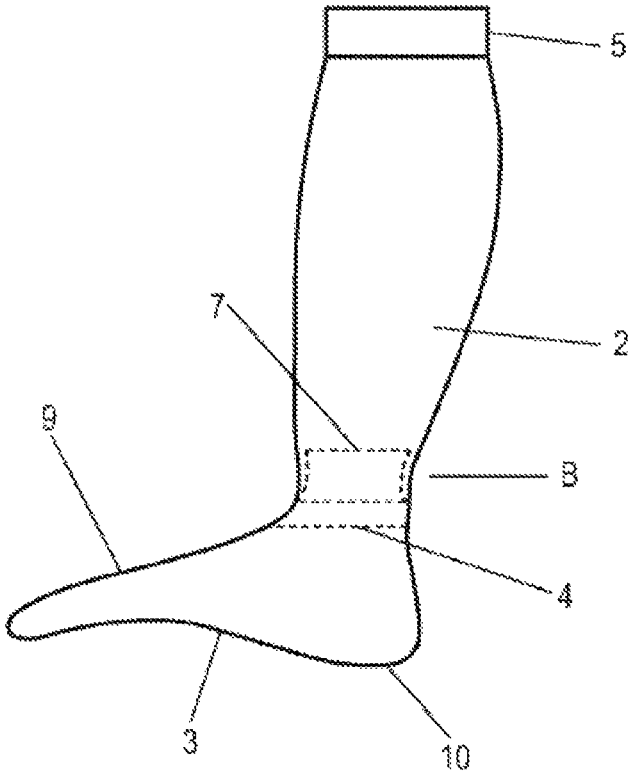
Figure 5:
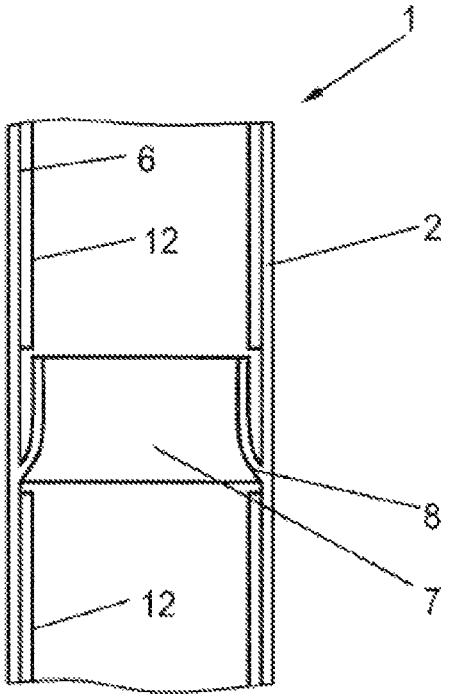
Figure 6:
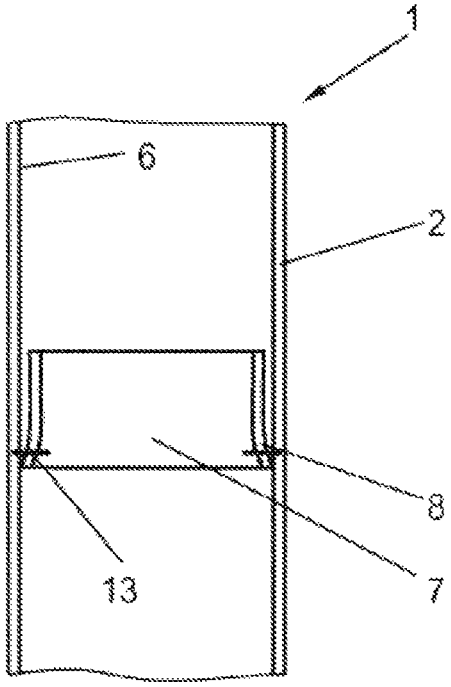
Figure 7:
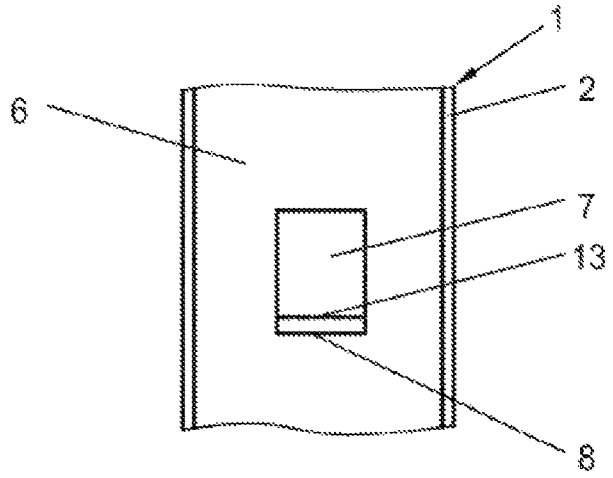
Figure 8:
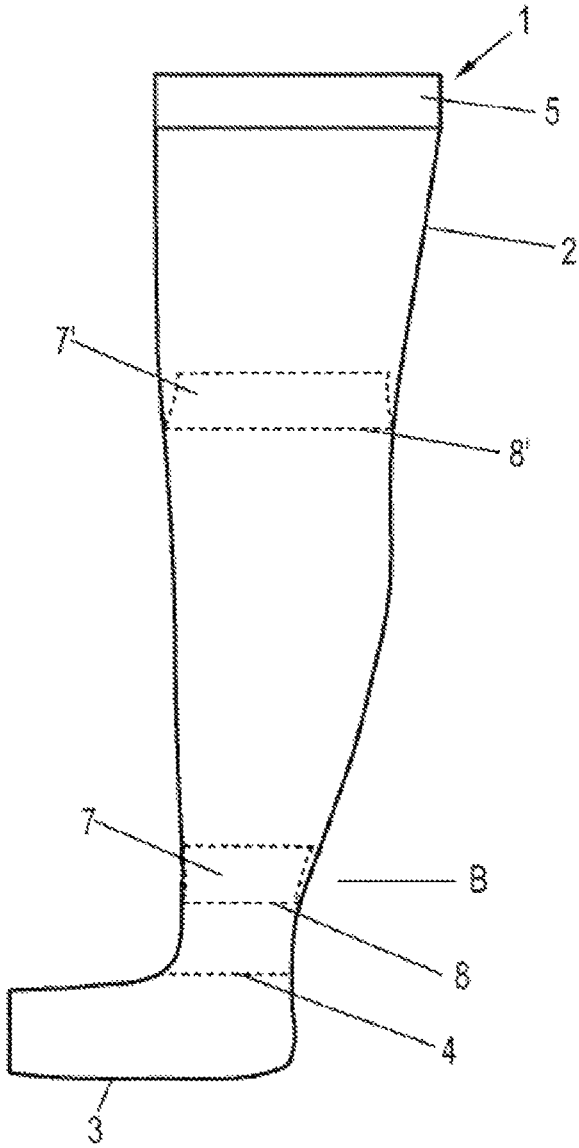
Figure 9:
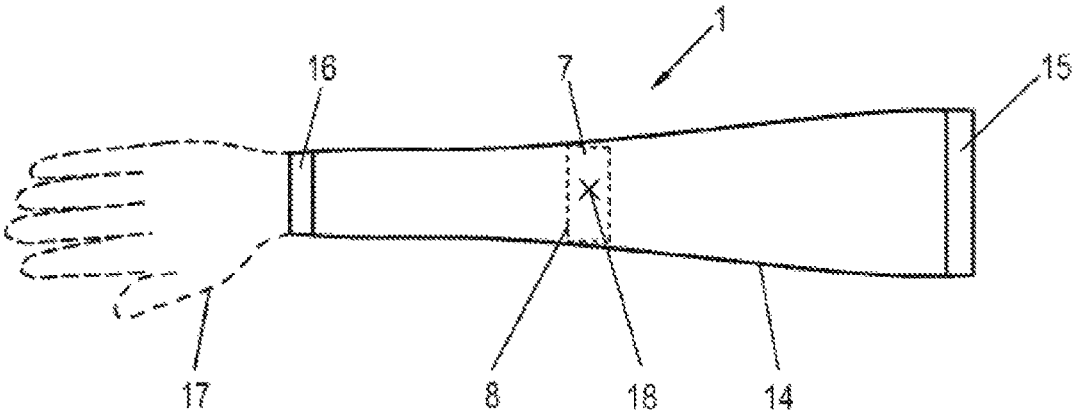

Further advantages and details of the present invention result from the exemplary embodiments described hereinafter and in reference to the drawings. In the figures:

FIG. 1 shows a knitted fabric article according to the invention in the form of a calf stocking in the basic position having the leg section turned inside out, FIG. 2 shows a side view of the knitted fabric article from FIG. 1, FIG. 3 shows the knitted fabric article from FIG. 1 in the pulled-off form, FIG. 4 the knitted fabric article from FIG. 3 in a side view, FIG. 5 is an enlarged partial view of a knitted fabric article according to the invention in the area of the arrangement of an annular pulling element which is knitted in one piece with the leg section, FIG. 6 shows a partial view of a knitted fabric article according to the invention in the area of a pulling element arranged on the leg section, which is connected to the leg section as a separate pulling element, FIG. 7 shows a further partial view of a knitted fabric article according to the invention having a local pulling element, FIG. 8 shows a side view of a knitted fabric article in the form of a long thigh-length stocking having two pulling elements located at different longitudinal positions, and FIG. 9 shows a side view of a knitted fabric article in the form of an armsleeve.

FIG. 1, and also the side view according to FIG. 2, shows a knitted fabric article 1 according to the invention in its basic position turned inside out, which is knitted as a circular knitted fabric on a circular knitting machine or as a flat knitted fabric on a flat knitting machine as a one-piece knitted fabric article. It comprises, see also FIGS. 3 and 4, which show the knitted fabric article 1 in the pulled-off position, a tubular leg section 2 and a foot section 3 directly adjoining thereon. The leg section 2 preferably extends over the ankle to just before the heel, on which the foot section 3 adjoins. This is shown by way of example via the dashed dividing line 4 in FIG. 4. At the upper end of the leg section 2, a shoulder 5 is knitted on, which can be pulled, inter alia, to put on the knitted fabric article 1 in the longitudinal direction.

The knitted fabric article 1 is, for example, a compressive knitted fabric article in which the basic knitted fabric that forms the leg section 2 and the foot section 3 and is knitted from at least one basic knitted thread is equipped with a compressive property at least in sections and at least in the leg section 2. Of course, the entire knitted fabric article 1 can be compressive both in the leg section 2 and in the foot section 3. This is imparted by introducing an elastic thread into the basic knitted fabric, for example as a weft thread, which opposes the stretching in the circumferential direction with a resistance, so that a compression pressure can be applied to the underlying, overlapped fabric. The compression of the knitted fabric article 1, in particular in the leg section 2 (or in the arm section in the case of an armsleeve) can be determined using an appropriate measuring device, as specified for example in DIN 58133 or the comparable quality assurance RAL-GZ 387/1 "Medizinische Kompressionsstrümpfe [Medical compression stockings]" of the German Institute for Quality Assurance and Labeling e.V. This measurement is preferably determined using the "HOSY" or "HOSYcan" testing device, which is used in particular for the compression pressure measurement on compression textiles, in particular medical compression textiles, from the Hohenstein Textile Testing Institute GmbH & Co. KG. This applies to all exemplary embodiments described.

Putting on such a knitted fabric article 1 or stocking, in particular if it is compressive, causes great difficulties for older people or people having restricted mobility. Because of the anatomically knitted basic shape of the leg and foot sections and the resulting narrow diameter transition area from the leg to the foot section, it is sometimes difficult to pull the stocking over the heel area in particular. This problem is all the greater when the stocking has compressive properties adjacent to or also in the transition to the foot section 3.

In order to make it easier to put on, at least one pulling element 7 is arranged on the inside 6 of the leg section 2 and is used to pull the knitted fabric article 1 longitudinally. FIGS. 1 and 2 show the knitted fabric article 1 in the basic position in which the knitted fabric article is located before being put on. In this, the leg section 2 is slipped over the foot section 3 so that the inside 6 of the leg section 2 is on the outside. In the basic form shown, the pulling element 7 is exposed, so it can be gripped with two hands without problems.

The pulling element 7 is designed here as an annular, circumferential pulling element 7, which is firmly fastened at a lower end 8 on the inside 6 of the leg section 3, while the pulling element 7 is otherwise free or loose, as shown in FIGS. 3 and 4, where the pulling element 7 is shown guided slightly inwards.

As shown in FIG. 1, an optical marking 18, for example a knitted-in thread or an imprint or the like, is provided on the outside of the pulling element 7, which preferably has a different color than the leg section 2 and the foot section 3. This optical marking 18 shows where the upper side 9 of the foot part 3 is, so that the user can orient himself thereon and bring the knitted fabric article 1 into a correct position relative to the foot or leg, respectively. This is because, as FIGS. 1-4 show, the foot section 3 naturally also has an anatomical shape corresponding to the foot, in that a corresponding heel section 10 on the one hand and a corresponding toe section 11 on the other hand are provided thereon. Correct positioning relative to the foot can now take place via this optical marking 18, so that the foot can be slipped correctly into the foot section 3.

In the context of putting it on, the knitted fabric article 1 is first gripped on the annular pulling element 7 and pulled with the foot section 3 over the toes and further over the foot, starting from the basic shape turned inside out according to FIGS. 1 and 2. In particular, pulling over the heel often turns out to be very difficult, in particular if the knitted fabric article 1 has compressive properties. In this case, the lower section of the leg section 2, which has a significantly reduced diameter and is quasi-adjacent to the dividing line shown in FIG. 4, has to be pulled over the heel, which is known to be relatively wide as indicated in FIG. 2 in the side view. This means that the knitted fabric article 1 or the leg section 2 has to be greatly stretched in this area, which is sometimes very difficult with a compressive knitted fabric.

However, because the annular pulling element 7 is arranged on the leg section 2, a strong direct pull can be exerted on the lower area of the leg section 2 and via this on the foot section 3 in the longitudinal direction, which significantly simplifies pulling over the heel area.

As shown in particular in FIG. 4, the annular pulling element 7 or, in principle, the pulling element or elements (multiple pulling elements can also be provided) is located at a longitudinal position of the leg section 2, which is in the vicinity of the lower end of the leg section, i.e., in the area of or adjacent to the transition to the foot section 3, if one is provided. If no foot section 3 is provided, the pulling element 7 is located in the vicinity of or adjacent to the lower edge of the leg section 2, i.e., in the vicinity of the section which is greatly reduced in diameter. The pulling element 7 is consequently located just in the area which is very narrow in diameter in comparison to the rest of the area of the leg section 2 adjoining it towards the shoulder 5 and which is in particular very difficult to pull over the heel. That is, a strong longitudinal pull can be introduced in a very directed and immediate manner into the corresponding leg section area, which is difficult to pull over, via the pulling element 7, which significantly simplifies putting it on.

If, starting from the basic position shown in FIGS. 1 and 2, the foot is inserted into the foot section 3 and the lower leg section area is accordingly pulled over the heel and the ankle, the shoulder 5 is gripped and the remaining leg section area of the leg section 2 is pulled up and over the calf until the stocking is completely pulled up and in the wearing position. In this position, the leg section 2 now overlaps the pulling element 7 with its inside 6, so this is located between the leg and the leg section knitted fabric.

The pulling element 7, which is designed to be annular here, can be a pulling element which, like at least the leg section 2, has compressive properties, i.e., it exerts pressure on the covered tissue. For this purpose, the pulling element 7 can also be knitted and provided with an elastic thread which causes the compression. Alternatively, the pulling element 7 can also consist of a flat material that is elastic in the circumferential direction, such as a plastic film or the like, so that a corresponding pressure acting radially inward can also be generated via this. If the leg section 2 is also equipped to be compressive, the two compressive sections overlap in the overlapping area, i.e., in which the leg section 2 lies above the pulling element 7. This means that there is a layer doubling there, made up of the pulling element 7 and the leg section 2, as well as two separate compressions which are superimposed. A overall pressure arises there, resulting from the pressure exerted via the pulling element 7 and the pressure exerted via the leg section 2.

As FIGS. 3 and 4 show, the ring-shaped pulling element 7 is preferably arranged in a B area (ankle) defined according to DIN 58133 (alternatively, it can also be arranged in the B1 area according to DIN 58133). According to DIN 58133, the highest compression pressure is to be generated in this B area if the knitted fabric article 1 is a compression stocking. A corresponding pressure can now be generated in a simple manner by superimposing the two individual compressions, wherein the pressure can be varied within a relatively wide range. This is because the greater the additional pressure component generated via the pulling element 7, the higher the local overall pressure can be set. That means that in the wearing position, a relatively high local overall pressure results. However, this high pressure provided in the wearing position does not have a disadvantageous effect when putting the article on. Because the pulling element 7 is separate from the leg section 2 when putting the article on, i.e., they do not overlap, only the pulling element 7 is to be stretched when pulling over the heel, and the corresponding leg section area only thereafter. This means that only one layer has to be stretched in each case, but not the double layer provided in the wearing position having the significantly higher overall pressure.

FIG. 5 shows a partial view of a knitted fabric article 1 according to the invention, wherein identical reference numerals are used for identical parts. It is assumed as an example that the knitted fabric article 1 is again a calf stocking. Alternatively, this can of course be a different type of knitted fabric article, such as a half-thigh stocking, tights, or an armsleeve, with or without a foot or hand section.

A sectional view is shown through the area in which the pulling element 7, annular again here, is arranged. On the one hand, the tubular leg section 2 is shown, which consists of a basic knitted fabric made of at least one knitted fabric thread. If the leg section 2 is compressive, then an elastic thread is additionally introduced, for example as a weft thread.

In this embodiment, the pulling element 7 is also a knitted pulling element 7 which is knitted in one piece onto the leg section 2 with its end 8. This knitting on as a quasi-freely hanging, flexible and ring-shaped "lobe" is readily possible on both a circular knitting machine and a flat knitting machine. The pulling element 7 is either knitted from the same knitted thread as the leg section 2 and, if necessary, also equipped with a compressive effect by introducing an elastic thread. However, it is also conceivable to knit the pulling element 7 from a different, preferably thinner and possibly different colored knitted thread than the knitted thread of the leg section 2, so that ultimately the thickness of the pulling element 7 can be reduced somewhat and it does not stand out too clearly in the wearing position. Also, if it is designed to be compressive, a different elastic thread can be introduced into the pulling element 7 than in the leg section 2, via which the compression pressure of the pulling element 7 can be varied in a simple manner.

In order to prevent the pulling element 7, which is overlapped by the leg section 2, from clearly standing out in the wearing position and a corresponding, slight bead-shaped protrusion resulting, in the exemplary embodiment according to FIG. 5, padding 12 is provided on the inside 6 of the leg section 2, preferably in the form of a plush or a plush layer, which is also formed at the same time when the leg section 2 is knitted. This padding 12 increases the thickness of the leg section 2. As shown in FIG. 5, it extends on both sides of the pulling element 7 in the example shown and adjoins it seamlessly or at a slight distance. In the wearing position, this padding 12 now compensates for the double-layer bulge resulting from the overlap, so that no or only an insignificant corresponding peripheral edge or bead is formed.

In the embodiment according to FIG. 5, the pulling element 7 is knitted and is knitted onto the leg section 2 in one piece. In the variant according to FIG. 6, the pulling element 7, which is also annular here, is a separate element that can either be knitted from a knitted thread, can optionally also be equipped to be compressive via an elastic thread, or consists of a flat material that is elastic in the circumferential direction but is as rigid as possible in the transverse direction, in particular a plastic material. This separate pulling element 7 is now firmly connected to the inside 6 of the tubular leg section 2 in the area of the lower end 8 of the pulling element 7 via a corresponding connection 13, which is only indicated schematically in FIG. 6. This connection 13 can be a seam, for example, which means that the pulling element 7 is sewn on. Alternatively, it can also be an adhesive bond. Independently thereof, the connection 13 is to be designed in such a way that a high tensile force can be applied to the leg section 2 via the pulling element 7.

FIG. 7 shows an exemplary embodiment of a knitted fabric article 1 according to the invention in the form of a sectional partial view, in which a local pulling element 7 is arranged as the pulling element 7, which is either knitted in one piece as a knitted pulling element 7 on the inside 6 of the tubular leg section 2 with its lower end 8, or which is fastened on the inside 6 of the leg section 2 as a separate pulling element 7, which is knitted or consists of a planar section, via a connection 13, which is shown here as an example only by dashed lines. Two such local pulling elements 7, which are designed as quasi-free-standing tabs, are preferably provided diametrically opposite to one another on the inner circumference of the leg section 2. These local pulling elements 7 are preferably laterally open, i.e., designed as open tabs, which makes it possible to reach into the tab-shaped or double-layered or annular pulling element 7 with the finger and thus grip it manually very well and apply a high tensile force.

FIG. 8 shows a design of a knitted fabric article 1 according to the invention, here in the form of a long thigh-length stocking, again comprising a leg section 2 and a foot section 3 knitted thereon. The foot section 3 is shown here having an open toe end as an example.

Again, the knitted fabric article 1 can be a non-compressive or a compressive knitted fabric article 1, wherein the advantages of the arrangement of the pulling element or elements 7 are naturally provided in particular in the case of a compressive knitted fabric article 1. In the exemplary embodiment shown in FIG. 8, a first pulling element 7, here again by way of example an annular pulling element 7, is fastened using its lower end 8 on the inside 6 of the tubular leg section 2, preferably in the B region, for example knitted in one piece or separately sewn on or adhesively bonded on as described above. In this design, at a second longitudinal position along the leg section 2, a further pulling element 7', annular again here as an example, is provided with its lower end 8', which of course is preferably connected in the same way as the first pulling element 7 to the inside 6 of the leg section 2, thus is also knitted on in one piece or is sewn on or adhesively bonded on as a separate pulling element 7'.

This design, having pulling elements 7, 7' provided in two longitudinal positions or in two longitudinal planes, enables the long thigh-length stocking to be put on in a quasi-multistep, optimal manner. In the basic position, the leg section 2 is slipped over the foot section 3, similarly to the shorter calf stocking according to FIG. 1. Similar to FIG. 1, the first pulling element 7 is exposed at one end and can be gripped so that the foot can be inserted into the foot section 3 or the foot section 3 and the lower end of the leg section 2 can be pulled over the heel.

In the next step, the second pulling element 7, which is also exposed on the outside because it is turned inside out, is then gripped, which makes it possible to pull the area of the leg section 2, which lies between the two pulling elements 7 and 7', further over the calf and over the knee, which means that with regard to this leg section area, a longitudinal pull can again be introduced directly into the knitted fabric in an optimal manner and this area can be brought into the wearing position. Then, in the last step, the shoulder 5 is grasped and then the terminal area of the leg section 2 is pulled into the final position over the thigh.

Of course, it is conceivable to also provide pulling elements 7, 7' in more than two longitudinal positions, as of course corresponding local pulling elements 7, 7' can also be provided instead of the annular pulling elements 7, 7'.

Also here, as in the designs according to FIGS. 6 and 7, there is of course the possibility of providing padding 12 on the inside 6.

Finally, FIG. 9 shows a knitted fabric article 1 in the form of an armsleeve, comprising an elongated, tubular arm section 14, having an upper end having a first shoulder 15 and a lower end here with a second shoulder 16. Instead of the second shoulder 16, as shown by dashed lines, a hand section 17 can also be knitted onto the arm section 14 in one piece. Of course, the arm section 14 and possibly also the hand section 17 are made from a basic knitted fabric made of at least one knitted thread and can optionally be equipped with a compressive property via an elastic thread.

Here, too, a pulling element 7, annular again here as an example, is fastened with its lower end 8 on the inside of the arm section 14 shown here with its outside, wherein the pulling element 7 can also be knitted on in one piece here or can be sewn on or adhesively bonded on as a separate knitted or flat-material pulling element 7. The pulling element 7 can also make putting on the article easier here, as described above for the other embodiments.

In the basic position, the arm section area shown to the right adjacent to the pulling element 7 in FIG. 9 is slipped over the arm section area shown to the left of the pulling element 7, so that the pulling element 7 is exposed and can be gripped to pull it over. After being pulled over the forearm, the shoulder 15 can then be gripped and the remaining arm section area can be pulled over the upper arm. The pulling element 7 can also have an optical marking 18 here, which indicates the correct orientation of the knitted fabric article 1 relative to the arm or hand, in particular if a hand section 17 is provided.

The invention claimed is:

1. A knitted fabric article comprising a leg or arm section to be pulled over at least a section of a leg or arm, wherein at least one manually grippable pulling element is provided on an inside of the leg or arm section, the inside touching the leg or arm when the knitted fabric article is worn, wherein the at least one manually grippable pulling element is attached to and does not form a part of the leg or arm section, and wherein the at least one manually grippable pulling element is shorter in length than the knitted fabric article and is located at a distance from an upper and a lower edge of the leg or arm section, wherein in the wearing position the manually grippable pulling element lies below the leg or arm section.

2. The knitted fabric article of claim 1, wherein the at least one manually grippable pulling element is designed to extend annularly around an inner circumference of the knitted fabric article, or wherein two pulling elements are arranged opposite to one another on the inner circumference.

3. The knitted fabric article of claim 1, wherein the at least one manually grippable pulling element is knitted element, or made of a flexible, flat material comprising a plastic material.

4. The knitted fabric article of claim 3, wherein the at least one manually grippable knitted pulling element is knitted in one piece with the leg or arm section, or is sewn or adhesively bonded on the leg or arm section.

5. The knitted fabric article of claim 1, wherein the leg or arm section is designed to be compressive.

6. The knitted fabric article of claim 1, wherein the at least one manually grippable pulling element is designed to extend annularly around an inner circumference of the knitted fabric article, and wherein the at least one manually grippable pulling element is compressive.

7. The knitted fabric article of claim 6, wherein both the at least one manually grippable pulling element and the leg or arm section are compressive in an overlapping area of the at least one manually grippable pulling element and the leg or arm section.

8. The knitted fabric article of claim 7, wherein the at least one manually grippable pulling element and the leg or arm section, which are compressive in the overlapping area, are at least approximately equally compressive, or in that they are differently compressive.

9. The knitted fabric article of claim 7, wherein the at least one manually grippable pulling element is arranged in area B or B1 according to DIN 58133 of the German Institute for Quality Assurance and Labeling for medical compression hosiery.

10. The knitted fabric article of claim 1, wherein at least one further pulling element is provided along the leg or arm section at at least one inside length position.

11. The knitted fabric article of claim 1, wherein padding is knitted in at least in sections on the inside of the leg or arm section.

12. The knitted fabric article of claim 1, wherein at least one optical marking, which indicates the location of the heel or hand section that is turned inside out in a basic position, is provided on the inside of the leg or arm section or on the at least one manually grippable pulling element.

13. The knitted fabric article of claim 1, wherein the at least one manually grippable pulling element is embodied in a different color than the leg or arm section.

14. The knitted fabric article of claim 1, wherein the knitted fabric article is a calf stocking, a half-thigh stocking, thigh-length stocking, or tights, or wherein the knitted fabric article is a half armsleeve or an armsleeve.

15. A method for putting on a knitted fabric article of claim 1, comprising:

turning the knitted fabric article inside out; pulling the knitted fabric article over a foot or a hand by pulling on the at least one manually grippable pulling element, gripping and pulling on an edge section of the leg or arm section, or pulling on at least one further manually grippable pulling element and then gripping and pulling on an edge section of the leg or arm section to further pull the knitted fabric article over the leg or arm into a wearing position.

16. The knitted fabric article of claim 1, wherein the at least one manually grippable pulling element comprises two pulling elements, and wherein two pulling elements are arranged opposite to one another on the inner circumference.

17. The knitted fabric article of claim 1, wherein the at least one manually grippable pulling element is designed to extend annularly around an inner circumference of the knitted fabric article, and wherein the at least one manually grippable pulling element is not compressive.

18. The knitted fabric article of claim 17, wherein only the leg or arm section is compressive in an overlapping area of the at least one manually grippable pulling element and the leg or arm section.

* * * * *